US009109436B2

(12) United States Patent
Leighton et al.

(10) Patent No.: US 9,109,436 B2
(45) Date of Patent: Aug. 18, 2015

(54) METHOD FOR REPAIRING A LINER HANGER, DEVICE AND BLANK FOR IMPLEMENTATION THEREOF

(75) Inventors: James Leighton, L'hermitage (FR); Frédéric Nicolas, Breal Sous Montfort (FR); Yoann Riou, Laille (FR); Benjamin Saltel, Cintre (FR); Gwenaël Tanguy, Pace (FR); Samuel Thiebaut, Bruz (FR)

(73) Assignee: Saltel Industries (FR)

( * ) Notice: Subject to any disclaimer, the term of this patent is extended or adjusted under 35 U.S.C. 154(b) by 426 days.

(21) Appl. No.: 13/520,393

(22) PCT Filed: Dec. 29, 2010

(86) PCT No.: PCT/EP2010/070851

§ 371 (c)(1),
(2), (4) Date: Sep. 26, 2012

(87) PCT Pub. No.: WO2011/083066

PCT Pub. Date: Jul. 14, 2011

(65) Prior Publication Data

US 2013/0140022 A1 Jun. 6, 2013

(30) Foreign Application Priority Data

Jan. 7, 2010 (FR) ..... 10 50079

(51) Int. Cl.
*E21B 43/10* (2006.01)
*E21B 29/10* (2006.01)

(52) U.S. Cl.
CPC ..... *E21B 43/103* (2013.01); *E21B 29/10* (2013.01); *E21B 43/105* (2013.01)

(58) Field of Classification Search
CPC ... E21B 43/103; E21B 43/105; E21B 43/108; E21B 29/10
USPC ..... 72/370.07, 370.08; 166/277, 382, 387, 166/208, 212, 384
See application file for complete search history.

(56) References Cited

U.S. PATENT DOCUMENTS

| | | | | |
|---|---|---|---|---|
| 4,942,925 | A * | 7/1990 | Themig | 166/382 |
| 7,168,499 | B2 * | 1/2007 | Cook et al. | 166/384 |
| 2004/0079534 | A1 | 4/2004 | Harrall et al. | |

FOREIGN PATENT DOCUMENTS

| | | | | |
|---|---|---|---|---|
| GB | 2402952 | A | 12/2004 | |
| WO | 9923354 | A1 | 5/1999 | |
| WO | WO2009/103629 | * | 8/2009 | E21B 21/00 |

OTHER PUBLICATIONS

International Search Report for Application No. PCT/EP2010/070851 dated Feb. 11, 2011.

*Primary Examiner* — Cathleen Hutchins
(74) *Attorney, Agent, or Firm* — Lerner, David, Littenberg, Krumholz & Mentlik, LLP

(57) ABSTRACT

Method for repairing a hanger (D) of a liner (B), for making a leak-tight connection, the liner (B) being placed inside and in the continuation of the casing (A) of a well, the method consisting in axially positioning a metal tubular blank (1) in the well, the blank having a solid wall radially deformable beyond its elastic limit and comprising an upper cylindrical portion (10) whose outer diameter is slightly smaller than the inner diameter of the casing (A), a lower portion (13) also cylindrical whose outer diameter is slightly smaller than the inner diameter of the liner (B), and an intermediate portion (11, 12) of diameter varying between these two diameters, and causing radial expansion of at least one of these two cylindrical portions (10, 13) beyond its elastic limit so that they are applied closely and firmly and in leak-tight manner against the inner face of the wall opposite the casing (A) or liner (B).

16 Claims, 13 Drawing Sheets

METHOD FOR REPAIRING A LINER HANGER, DEVICE AND BLANK FOR IMPLEMENTATION THEREOF

CROSS REFERENCE TO RELATED APPLICATIONS

The present application is a national phase entry under 35 U.S.C. §371 of International Application No. PCT/EP2010/070851, filed Dec. 29, 2010, published in English, which claims the benefit of French Patent Application No. 1050079, filed Jan. 7, 2010, the disclosures of which are incorporated by reference herein.

The present invention relates to a method and a device for repairing a liner hanger with a view to making it leak-tight. It also concerns a blank used for this repair.

The invention notably applies to hydrocarbon production wells (oil or gas) or to water catchment wells.

In the appended drawings, the scale in the radial dimension (i.e. perpendicular to the well axis) has been notably oversized compared with the scale in the longitudinal direction, for the sole purpose of improving legibility.

Appended FIG. 1 is an axial section of a (vertical) well, which helps situate the field of the invention and the problem to be solved.

P designates the wall of a hole drilled in the ground, in which a steel casing A is installed having an inner diameter ΦA.

B designates a liner, also in steel, of inner diameter ΦB smaller than the diameter of the casing, and which extends the casing (coaxially) towards the bottom of the well.

Reference D designates the liner hanger.

This is a more or less sophisticated device known per se and whose particular structure is not of importance. It is schematized here simply by a section that is approximately trapezoidal, capping the upper edge of the liner B with a conical entry wall PE.

The essential function of the liner hanger is to hold the liner in centred, leak-tight position.

Reference C designates cement cast between A and B.

The liner often projects beyond the end of the casing, towards the bottom of the well.

Over time, degradation of the liner hanger D is observed, with the onset of leaks. Undesirable fluids may then rise and enter into the casing as symbolized by the arrows R.

The liner hanger D must then be replaced, which is difficult and costly.

The main objective of the present invention is to allow repair of the liner hanger D simply and efficiently, to make it fully leak-tight, without too great a reduction in the diameter ΦB of the passageway used for passing tools and various components for operation of the well.

For this purpose, it proposes a repair method and device, and a blank which is used for this repair.

This method for repairing a liner hanger with a view to making it leak-tight, this liner being placed inside and in the continuation of a well casing, is characterized by the fact that it firstly comprises the axial positioning in the well of a metal tubular blank having a solid wall and radially deformable beyond its elastic limit, this blank comprising an upper cylindrical portion whose outer diameter is slightly smaller than the inner diameter of the casing, a lower portion that is also cylindrical whose outer diameter is slightly smaller than the inner diameter of the liner, and an intermediate portion with a diameter varying between these two diameters, this positioning being performed so that said lower portion comes to house itself in the mouth of the liner whilst said upper portion comes to position itself facing the zone of the casing located above the hanger, then during a second phase the method comprises causing radial expansion of at least one of these two cylindrical portions beyond its elastic limit so that it is applied closely and firmly and in leak-tight manner against the inner side of the wall facing the casing and liner, and so that subsequent to said expansion the intermediate portion of the blank covers the hanger.

Advantageously, use is made of a blank whose upper cylindrical portion has a wall whose mean thickness is greater than the thickness of said lower cylindrical portion, this upper portion being provided with at least one annular seal in swellable or expandable material, and radial expansion is only applied to the lower cylindrical portion beyond its elastic limit so that it is applied closely, firmly and in leak-tight manner against the inner side of the wall of the liner, followed by swelling or expansion of said seal to that it is applied it in leak-tight manner against the inner face of the casing wall.

In one preferred embodiment, a blank is used whose lower portion has an outer diameter that is very slightly smaller, almost equal (to the nearest insertion clearance) to the inner diameter of the mouth of the liner, previously machined and smoothed, and this lower portion is positioned by sliding into said mouth, with inter-positioning of seals, whilst radial expansion is only applied to the upper cylindrical portion beyond its elastic limit so that it is applied closely, firmly and in leak-tight manner against the inner face of the casing wall.

According to another variant, radial expansion is applied to each of the two cylindrical portions beyond their elastic limit so that they are applied closely, firmly, and in leak-tight manner against the inner faces of the walls respectively facing the casing and the liner, and so that subsequent to this expansion the intermediate portion of the blank, also deformed, covers the hanger.

According to other advantageous characteristics:

- said radial expansion is caused by means of a tool which comprises at least one inflatable packer bladder, sized so that it is adapted to the expansion of said upper and/or lower portions;
- said radial expansion is caused by means of a tool which carries a pair of inflatable packer bladders placed one above the other, and sized so that the upper bladder is adapted to expansion of the upper cylindrical portion of the blank, whilst the lower bladder is adapted to expansion of the lower cylindrical portion;
- said radial expansion of the upper part of the blank is caused by means of a first tool comprising an inflatable packer bladder sized so that it is adapted to the expansion of said upper portion, and by means of a second tool comprising an inflatable packer bladder sized so that it is adapted to the expansion of said lower portion;
- said blank is axially positioned in the well by means of said tool which comprises a supporting member provided with retractable fingers adapted to provide support to the lower edge of the blank while it is lowered and placed in the well;
- said blank is axially positioned in the well by means of said tool by inflating at least one of said bladders until it retains said blank by friction;
- radial expansion is first applied to the lower cylindrical portion and then to the upper cylindrical portion;
- radial expansion is first applied to the upper cylindrical portion and then to the lower cylindrical portion;
- said expansion is conducted "step-by-step", in successive inflating/deflating phases of said bladder, progressing in steps;

expansion is applied simultaneously to the upper and lower cylindrical portions.

use is made of blank having annular seals on the outer face of the cylindrical and intermediate portions thereof, so that after radial expansion of the lower portion, the intermediate portion is placed flat against said hanger in leak-tight manner.

The tool for repairing a liner hanger according to the invention, with a view to making it leak-tight, this liner being placed inside and in the continuation of the casing of a well, is characterized by the fact that it consists of a tool comprising a control rod which carries a pair of inflatable packer bladders placed one above the other, and sized so that the upper bladder is adapted to expansion of the upper cylindrical portion of the blank whilst the lower bladder is adapted to expansion of the lower cylindrical portion.

According to particular embodiments:

at least one of said bladders is mounted slidingly along said rod;

said tool, at the lower part of the rod, comprises a supporting member provided with retractable fingers, adapted to act as support for the lower edge of the blank while it is being lowered and placed in the well.

Finally, the invention concerns a blank used to repair a liner hanger, with a view to making it leak-tight, this liner being placed inside and in the continuation of the casing of a well, characterized by the fact that it comprises a metal tubular sleeve whose wall is radially deformable beyond its elastic limit, with coaxial upper and lower cylindrical portions, the diameter of the lower portion being smaller than the diameter of the upper portion, and an intermediate portion having a diameter varying between the diameters of the cylindrical portions.

According to advantageous characteristics:

said intermediate portion is in the form of a ferrule of truncated cone shape;

said intermediate portion comprises two parts in the form of ferrules of truncated cone shape, the half-angle at the top of the upper ferrule being larger than that of the lower ferrule;

said intermediate portion is of progressively variable shape i.e. of curved profile with inflection point;

the outer face of at least one of the cylindrical portions, and optionally of the intermediate portion, is provided with a series of ring seals in flexible, elastic, optionally swellable material;

said seals are bonded to said outer face;

said seals are rings housed in receiver grooves cut in the outer face of the cylindrical portions.

Other characteristics and advantages of the invention will become apparent on reading the following description of a preferred embodiment of the invention. This description is given with reference to the appended drawings in which.

Figure 4:
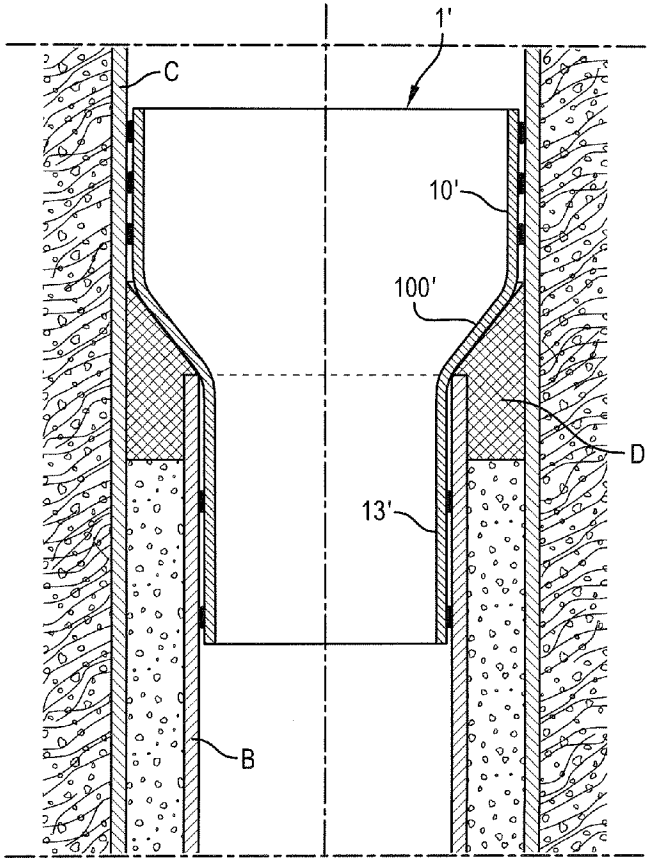
FIGS. 3 and 4 show a longitudinal section of the blank in position in a well, before and after expansion.
Figure 12:
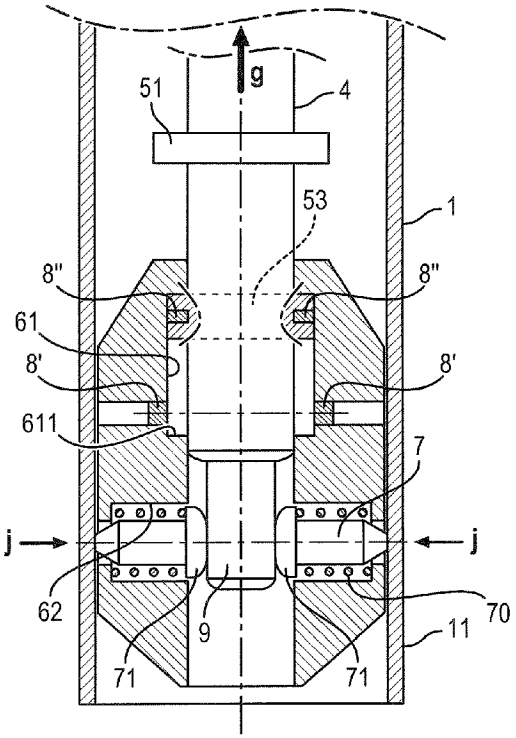
Figure 11:
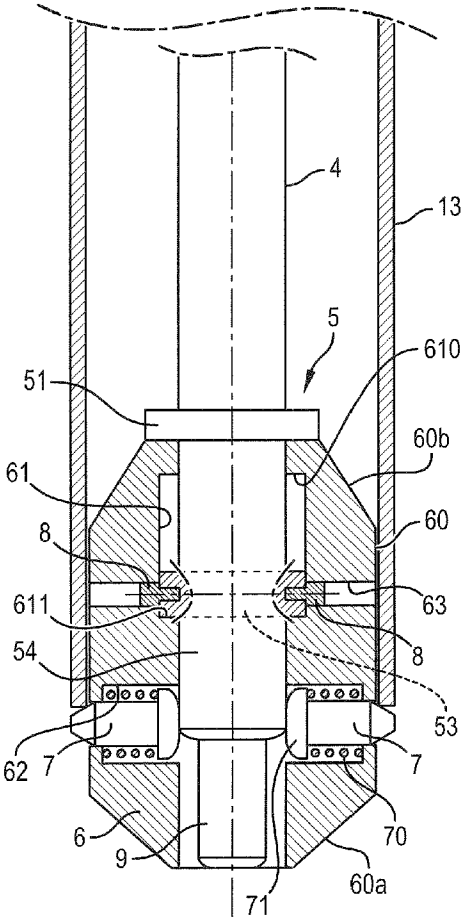
Figure 13:
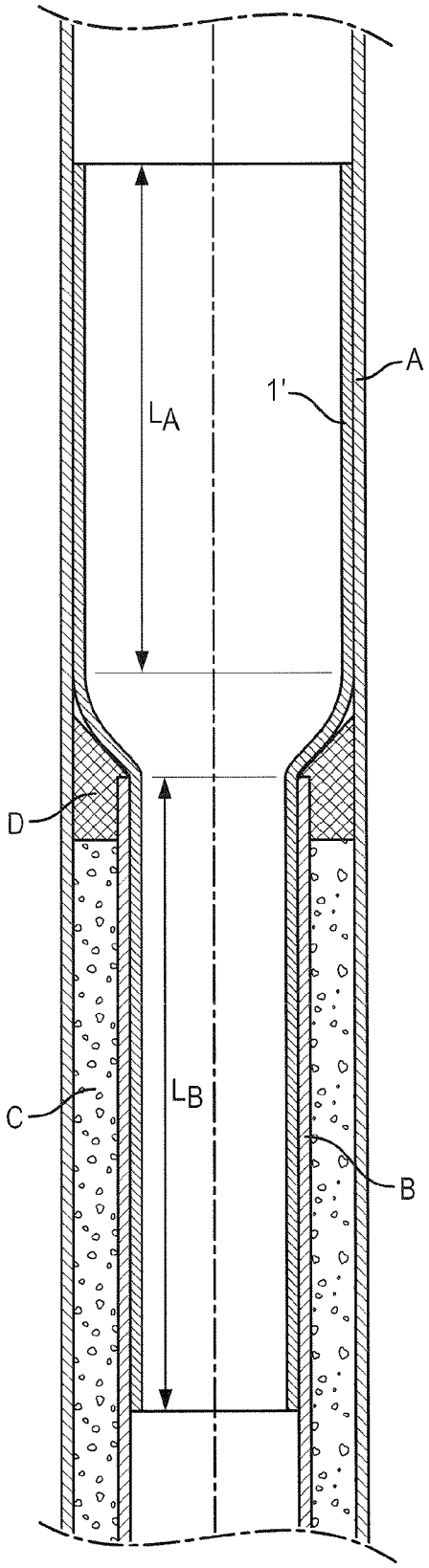
Figure 14:
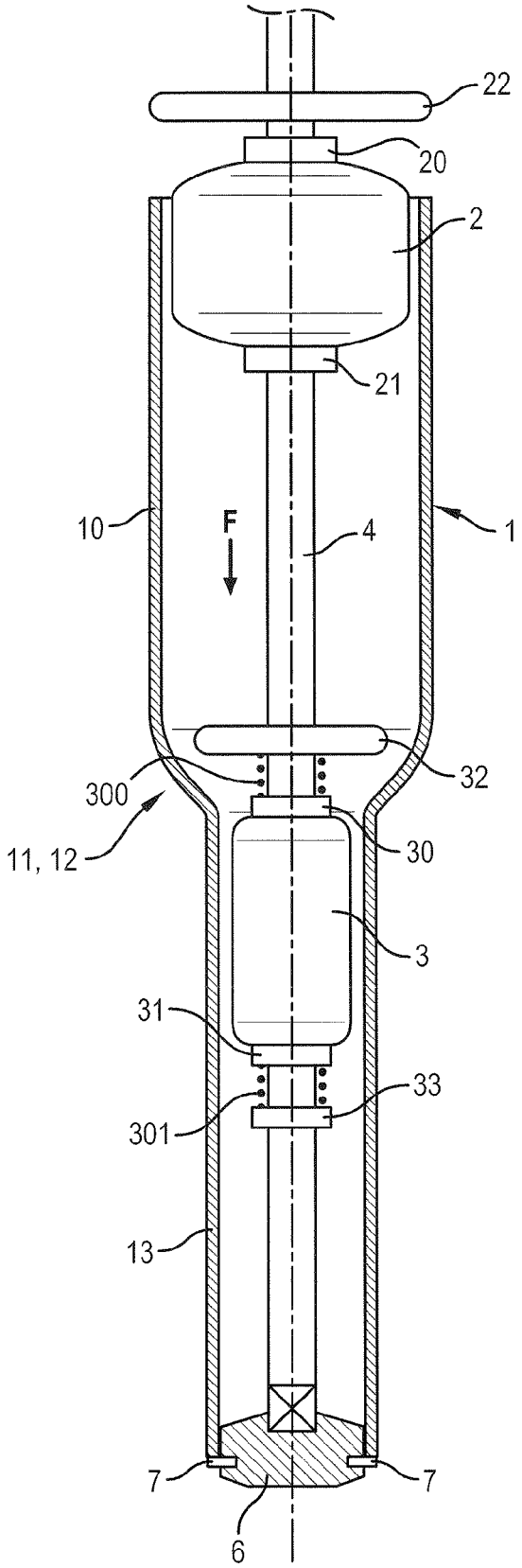
Figure 15:
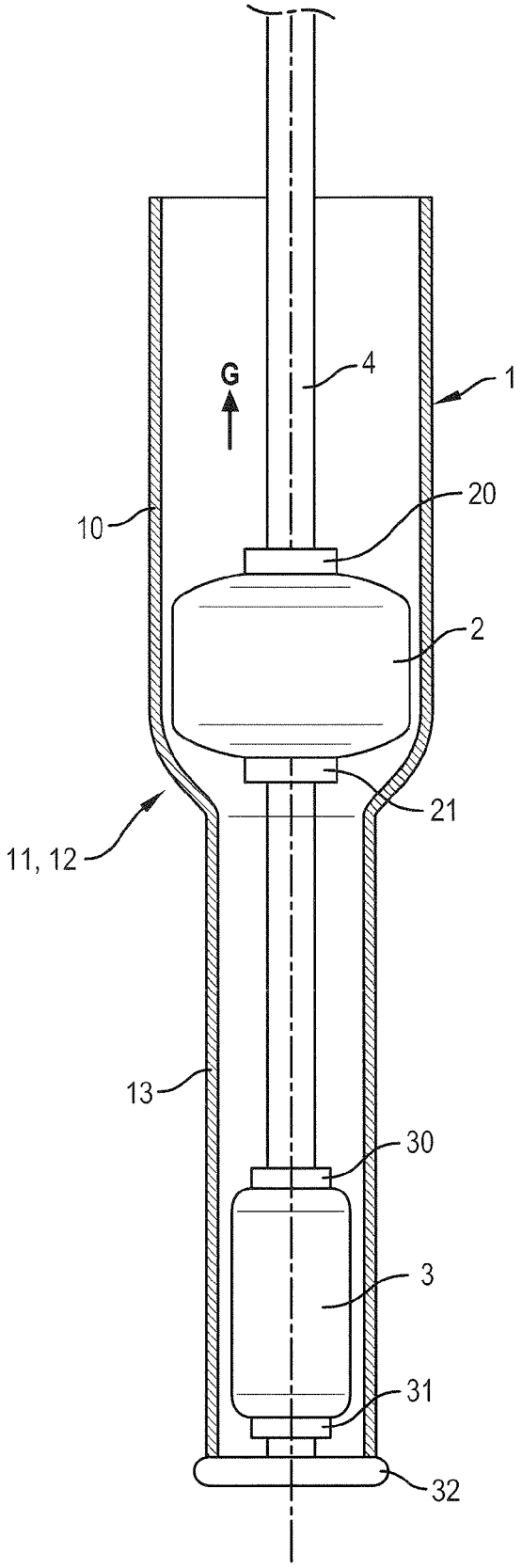
Figure 17:
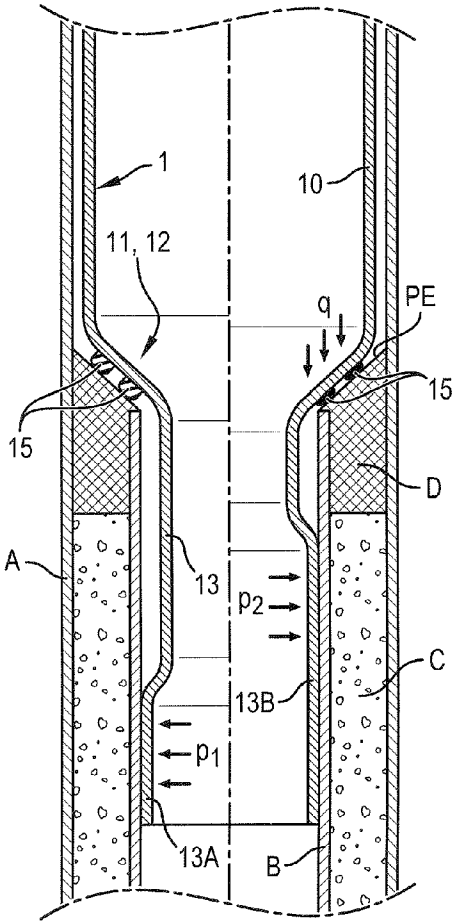
Figure 16:
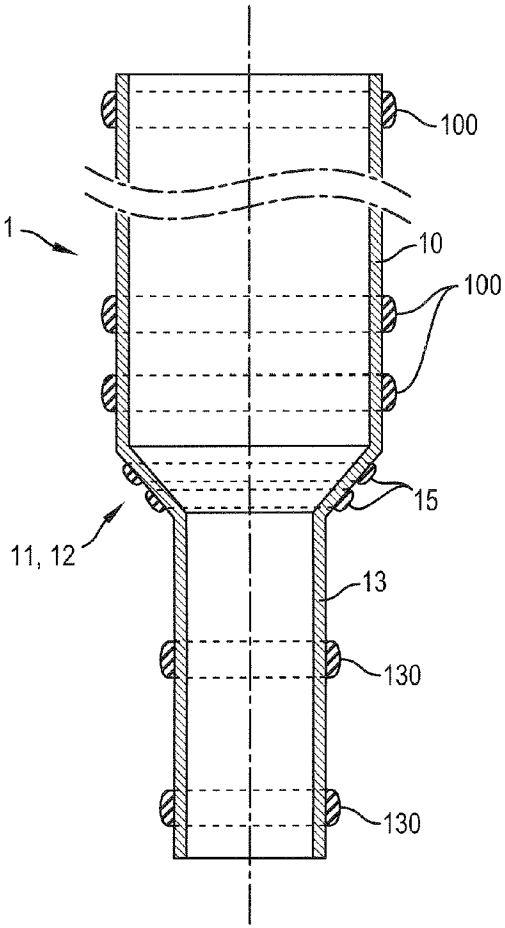
Figure 19:
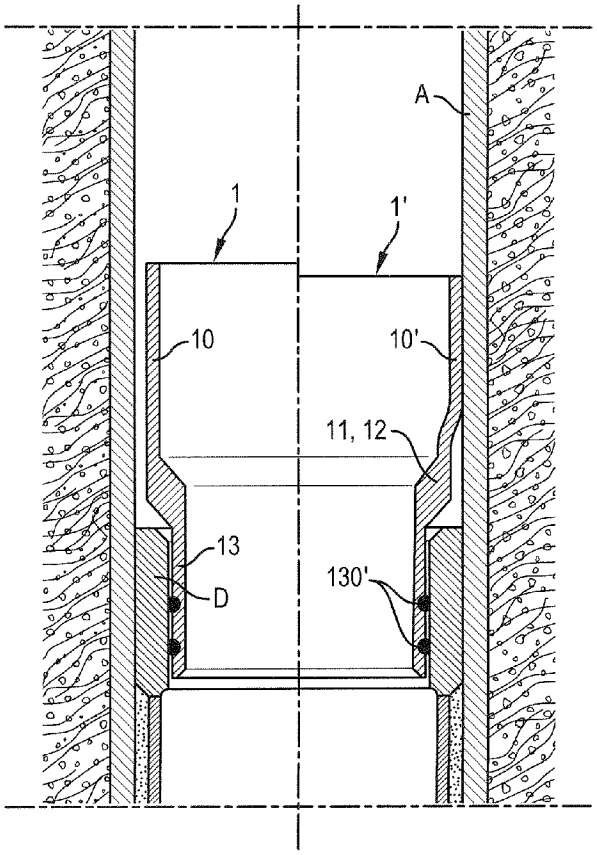
Figure 18:
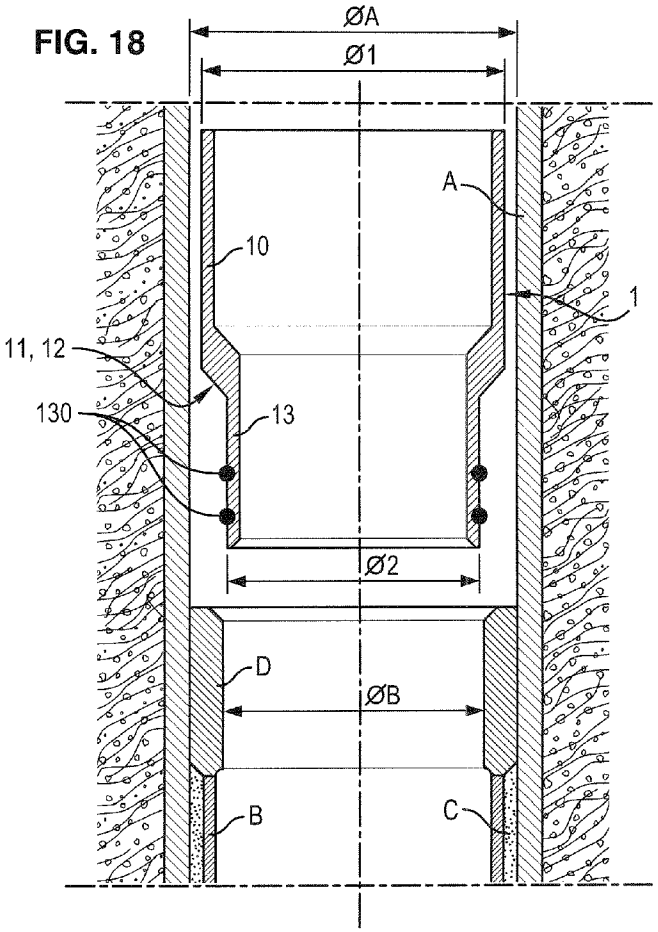

FIGS. 5 to 10 schematically show the device used to place the blank in position, and illustrate the different steps of the operation. It will be noted that in these figures, the section of the liner B has been simplified to impart a rectangular shape, with dashes, for the purpose of simplifying the drawings;

FIGS. 11 and 12 are cross-sectional views of the part of the device used to support the blank;

FIG. 13 is a similar view to FIG. 4 but in a configuration in which the casing and liner are covered over zones whose length is substantially greater than the effective length of the expanding packers, for example 3 times greater which will often be the case in practice;

FIG. 14 shows a tool carrying a blank, before positioning and expansion, and adapted for "step-by-step" operation, from top downwards, to obtain the result illustrated in FIG. 13;

FIG. 15 shows a similar tool to the one in FIG. 14, also adapted for "step-by-step" operation, but from bottom upwards;

FIG. 16 is an axial section of a blank whose intermediate portion is also provided with seals;

FIG. 17 is a view of the blank in FIG. 16, in place in a well, allowing understanding of how the radial deformation of the lower part of the blank generates axial downward movement of this intermediate portion, thereby causing clamping of the seals against the hanger;

FIGS. 18 and 19 give a longitudinal section view of a blank in position in a well, before and after expansion, but only of the upper cylindrical portion thereof.

Figure 2:
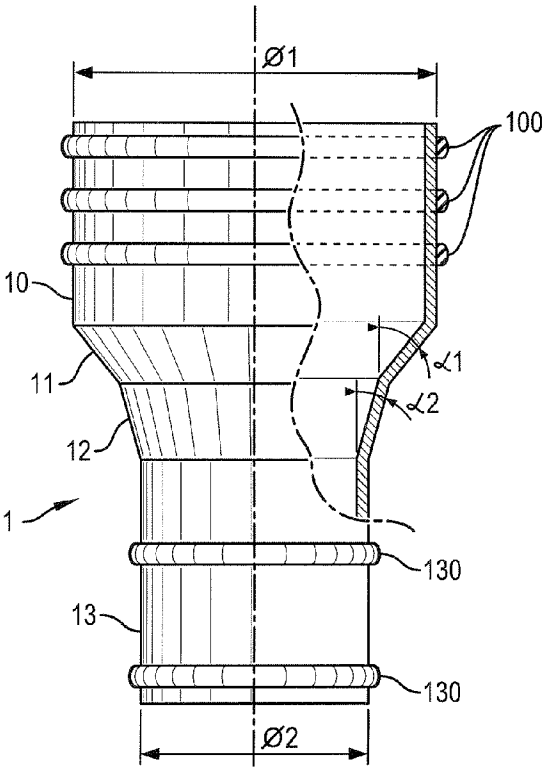
FIG. 2 is a partial cut-off view of the tubular blank.
Figure 1:
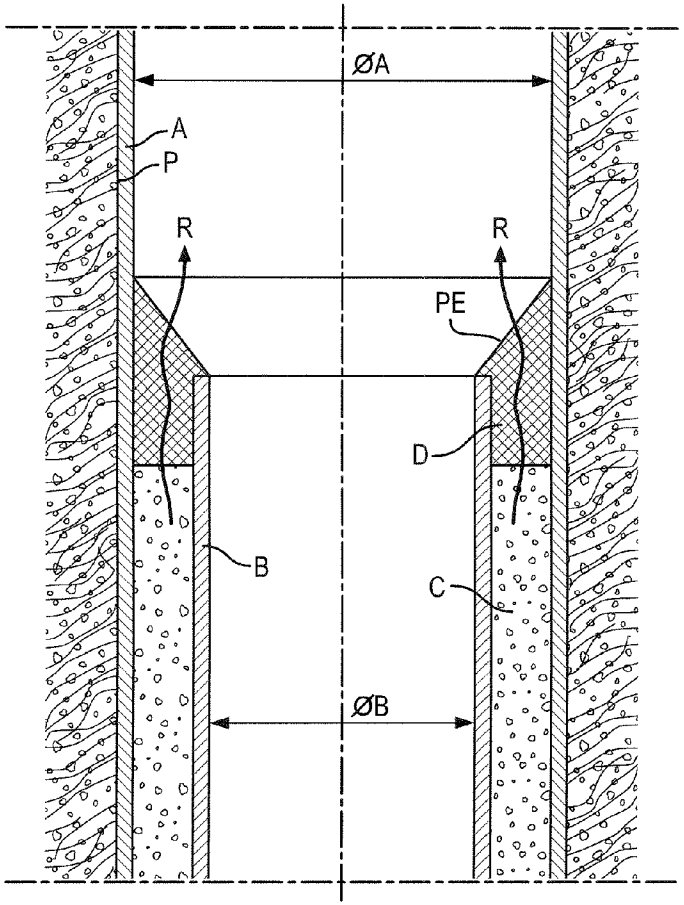
Figure 20:
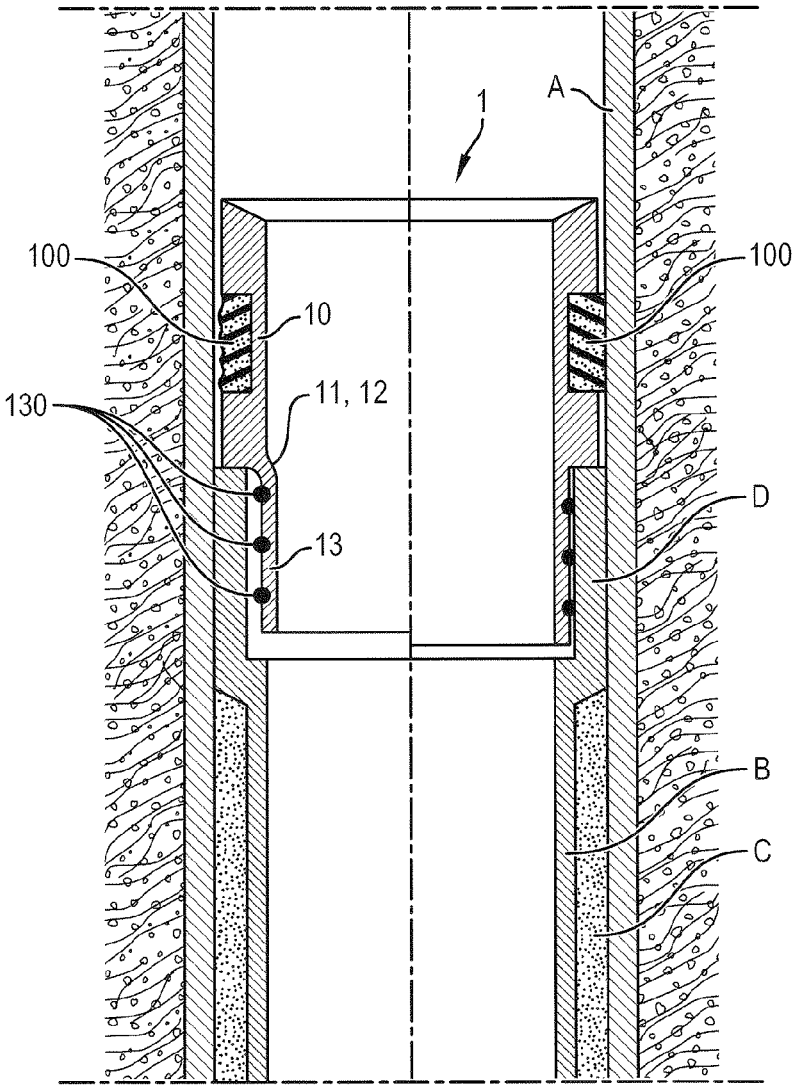

FIG. 20 is an axial section of another embodiment of the blank according to the invention;

The blank 1 in FIG. 2 is a solid wall annular envelope (neither perforated nor porous) in metal chosen to withstand mechanical and physicochemical stresses (pressure, temperature, corrosion . . . ) to which it will be exposed, whilst remaining sufficiently ductile so that it can expand radially beyond its elastic limit by a desired value.

A suitable metal is stainless steel.

This blank 1 comprises:

At the upper part, a portion 10 in the form of a cylindrical ferrule, whose outer diameter $\Phi 1$ is slightly smaller than the inner diameter $\Phi A$ of the casing;

At the lower part, a portion 13 in the form of a cylindrical ferrule, whose outer diameter $\Phi 2$ is smaller than $\Phi 1$, and also slightly smaller than the inner diameter 1B of the liner;

A "bi-conical" intermediate portion comprising two portions 11-12 in the form of ferrules of truncated cone shape; the half angle at the top $\alpha 1$ of the upper ferrule 11 is larger than that $\alpha 2$ of the lower ferrule 12.

These four elements can be joined to each other by welding.

The "bi-conical" intermediate portion (funnel or hopper shaped) ensures progressive transition between the two cylindrical portions, which reduces risks of rupture or cracking at this point during expansion of the blank.

The cylindrical portions 10 and 13 are advantageously surrounded by a series of bonded seals 100, 130, in flexible, elastic, optionally swellable material.

These could also be O-rings housed in receiver grooves (not illustrated) cut in the outer wall of these cylindrical portions.

Figure 3:
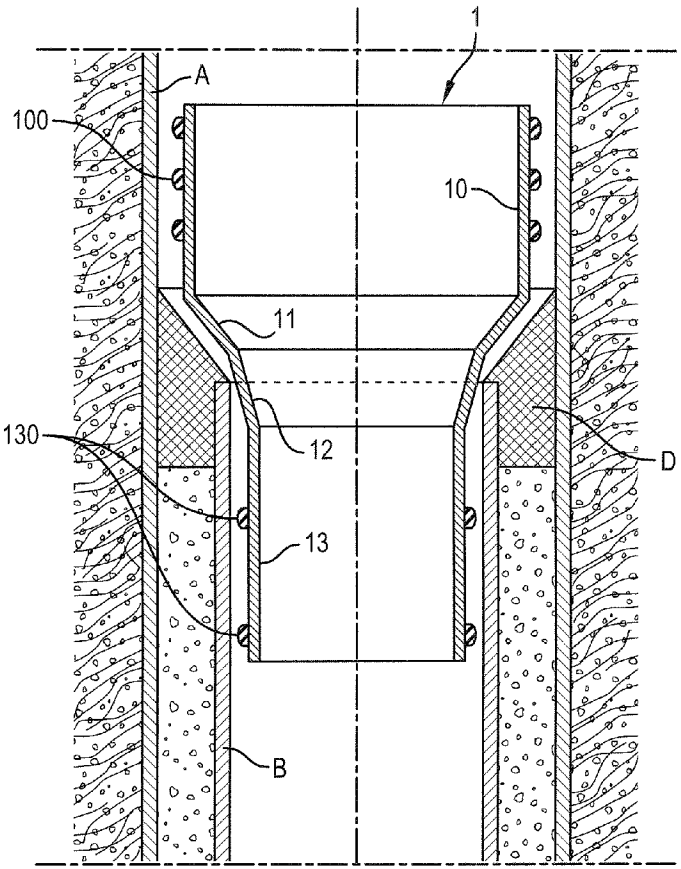

As shown in FIG. 3, the blank is conformed and sized so that when it is suitably positioned in the well, in the zone to be sealed, its intermediate portion 12 of smallest taper bears against the upper edge of the liner B which surrounds the hanger D, whilst its top 10 and bottom 13 cylindrical walls lie opposite the inner face of the casing A and inner face of the liner B respectively.

After expansion, the blank 1' has top 10' and bottom 13' cylindrical portions that are tightly and firmly applied against these inner faces, with inter-positioning of seals which have been compressed.

The intermediate portion 100', initially bi-conical, has assumed a curved shape and covers the hanger D, conforming to the desired objective.

In FIGS. 5 to 10, the sealing rings 100 and 130 are not illustrated so as not to encumber the drawings unnecessarily.

Figure 5:
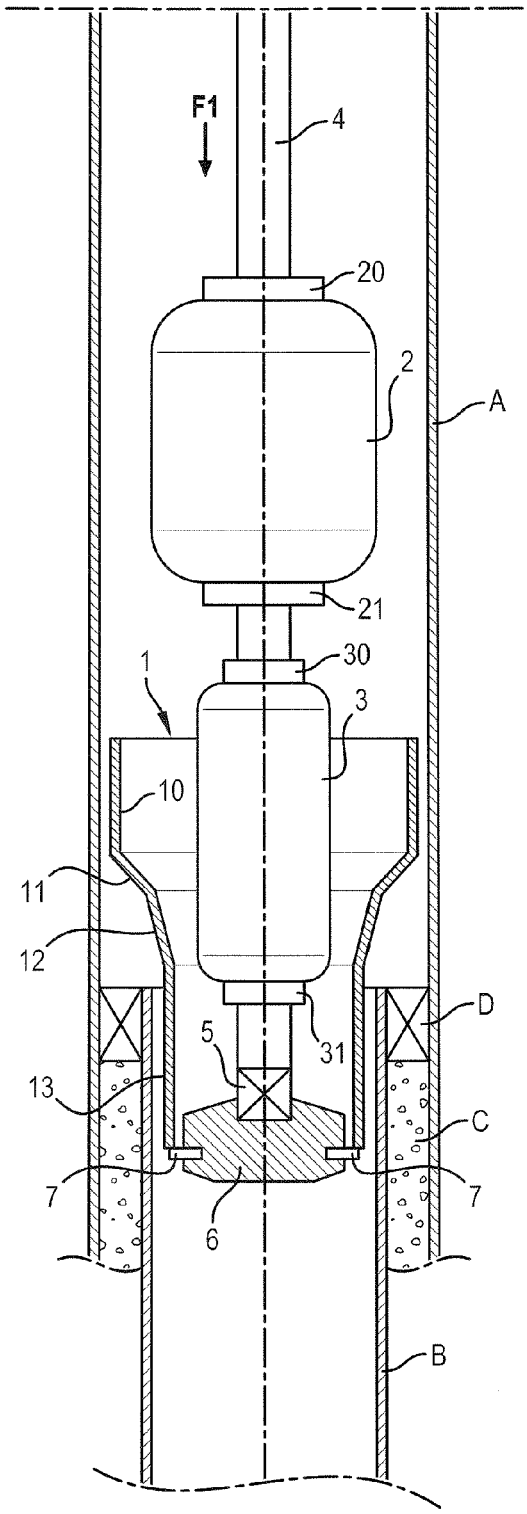

The tool for placing the blank in position, illustrated FIG. 5, comprises a central, tubular control rod 4, rigid or semi-rigid, on which two packers of usual type are arranged, one 2 lying above the other 3. These are inflatable bladders with an annular membrane that is flexible and elastically deformable in radial direction, which can be supplied with high pressure liquid using suitable known means, e.g. by pumping fluid present in the well, or from the head of the well via the hollow rod 4.

The membrane of each bladder 2, 3, via each of its top and bottom ends, is joined to a pair of end-pieces 20-21, respectively 30-31, of which at least one is able to slide freely on the rod 4, to offset the difference in axial length resulting from the variation in diameter of the bladder on inflating/deflating.

The diameters of the non-inflated packers 2 and 3 are slightly smaller than the inner diameters of the cylindrical portions 10, relatively 13, of the blank 1. Their length (axial dimension) is sufficient to cooperate with each of these portions, respectively, to achieve their expansion over their entire length. At its lower end, the rod 4 carries a supporting member 6 provided with a series of fingers 7 adapted to give support to the lower edge of the blank 1 while it is being lowered and placed in position in the well.

For example, there are four fingers 7 extending radially and horizontally, and arranged at 90° relative to the vertical axis of the rod 4.

They are retractable, the member 6 being connected to the rod 4 via a link system 5 symbolized by a square with diagonal lines. This system is designed to cause retracting of the fingers 7 by radial inward movement when the rod 4 is subjected to an upward traction force of excessive value which exceeds a determined threshold.

The member 6 has a smooth, cylindrical wall surface, adapted to fit into the lower opening of the blank 1 without any notable clearance, and more precisely into the lower portion 13 thereof of small diameter. This member thereby ensures good centering of the blank relative to the control rod 4, along the well axis, when the blank is placed in position in the well resting on the supporting fingers 7.

The arrow F1 in FIG. 5 illustrates the lowering of the tool/blank assembly inside the well by means of the rod 4, the two packers being deflated.

Figure 6:
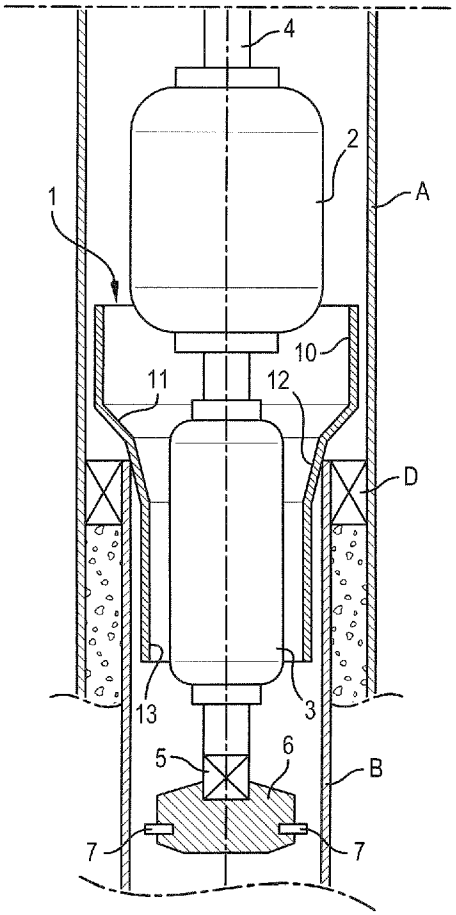

The lowering of the blank 1 is halted when its truncated cone portion 12 meets the upper edge of the liner B, and the tool continues its downward travel alone until the packer 3 is correctly positioned opposite portion 13 of the blank (FIG. 6).

Figure 7:
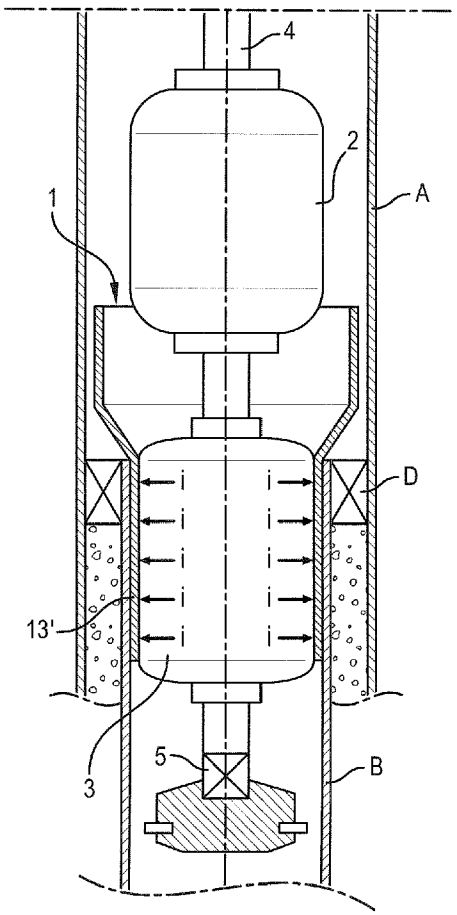

The lower packer 3 is then supplied with high pressure liquid causing inflation thereof—arrows i, FIG. 7—which causes radial expansion of this portion (now referenced 13') and firm application thereof against the upper zone of the inner wall of the liner B.

The packer 3 is then deflated and the tool is again lowered (Arrow F2, FIG. 8) over a short travel distance until the upper packer 2 is correctly positioned opposite portion 10 of the blank.

Figure 9:
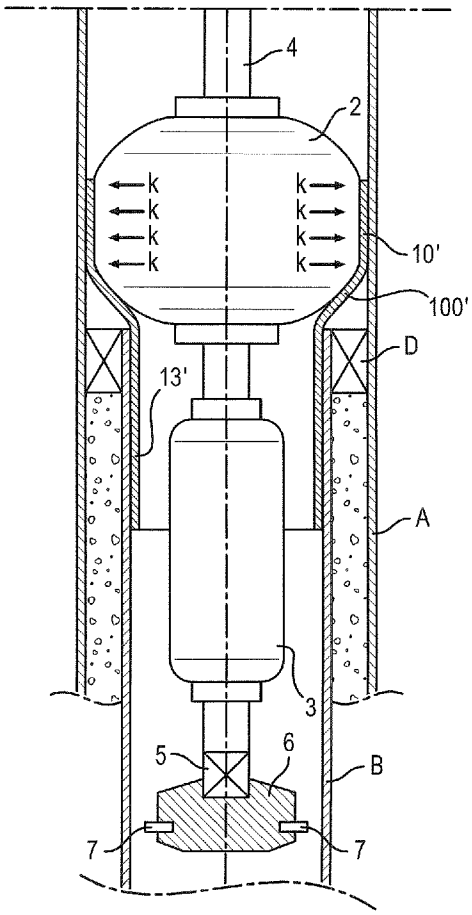
Figure 8:
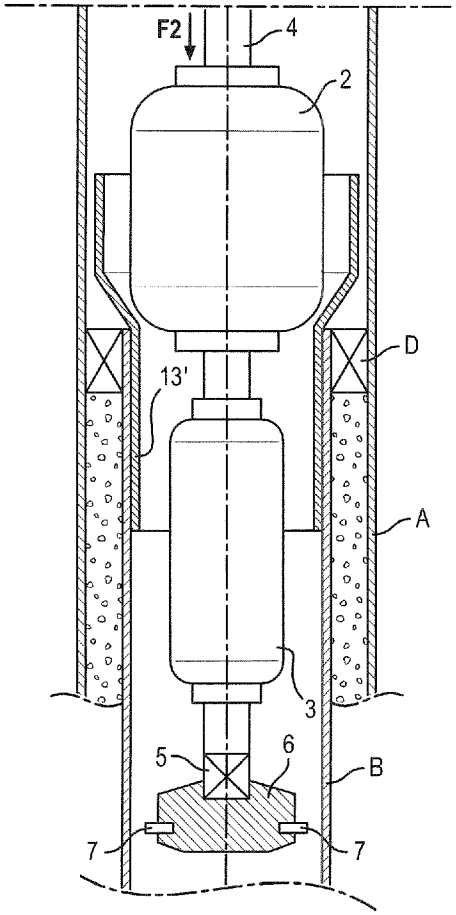

This packer 2 is then supplied with high pressure liquid causing inflation thereof—arrows k, FIG. 9—which causes radial expansion of this portion (now referenced 10') and firm application thereof against the zone of the inner wall of the casing B which is located above the hanger D.

Figure 10:
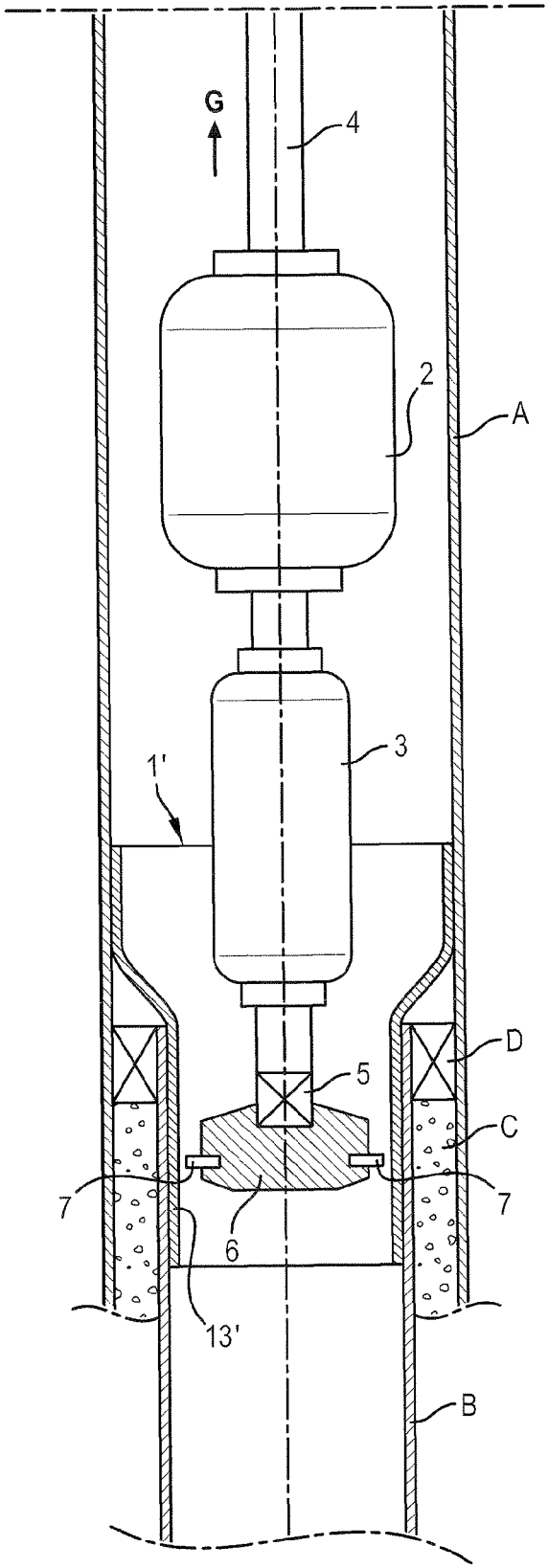

Finally, after deflating the upper packer 2, the tool can be withdrawn by upward axial traction (arrow G, FIG. 10).

Throughout this withdrawal, the supporting member 6—including its projecting retaining fingers 7—pass normally through the expanded blank 1', provided this expansion is properly and sufficiently performed, notably at the lower portion 13'.

If this is not the case, these fingers 7 come to strike the lower edge of this portion 13', and they can no longer be lifted.

In this hypothesis, the connection system 5 is subjected to a substantial traction force which causes retracting of these fingers so that the tool can nevertheless be withdrawn.

FIGS. 11 and 12 illustrate an arrangement allowing this result to be obtained.

The member 6 is a solid body with cylindrical wall and 60 and distal 60*a* and proximal 60*b* faces of truncated cone shape (forming chamfers capable of facilitating positioning and limiting friction). It contains a series of radial fingers 7 housed in ad hoc receiving holes 62 formed in the body 6. These are rods with domed head 71 (the head lying inwardly inside the body 6) and with truncated cone-shaped tip 70 which normally projects outside the body 6 to retain the lower edge of the blank, as illustrated in FIG. 11. It is the cylindrical wall of the rod 4 with diameter adapted accordingly, which normally and positively holds all the fingers 7 in this projecting position against small return springs 70 which, acting against the heads 71, tend on the contrary to repel the same inside the body 6 for retraction thereof.

It will henceforth be noted that the rod 4 has a lower end portion (distal) 9 of smaller diameter than the diameter of the main part thereof which holds the fingers in their active position in FIG. 12. In rest position (FIG. 11), the heads 71 bear against the portion of rod 4 of larger diameter, but just above the transition zone with this portion 9 of reduced diameter.

The rod 4 has an annular collar 51 which acts as shoulder for the base of the proximal (upper) face 60*b*, of truncated cone shape, of the body 6. The axial thrust forces exerted on the rod 4 are therefore transmitted to the body 6 from top downwards via this bearing zone.

The rod 4 has another annular collar 53 positioned lower than the first 51 in a cylindrical housing 61 arranged axially inside the body 6. The rod portion 4 located between the collars 51 and 53 carries reference 52.

This collar 53 is pierced with small radial bore holes 63, e.g. two in number, diametrically opposite (hence coaxial)—or four distributed at 90°. In each bore hole 63 a metal pin 8 is housed in the form of a small rod provided with a head which is fully driven into an opposite-facing bore hole pierced in the body 6.

The rod of these pins 8 has a calibrated cross-section so that it can withstand a given shear force and break on and after this value (frangible pins).

The housing 61 has a certain axial length in which the collar 53 is able to move from bottom upwards, when said pins are sectioned, until it comes to abut the upper end 610 of this housing 61.

In normal rest position (FIG. 11), the collar 53 on the contrary bears against the lower end 611 of the housing 61.

It is to be noted that the length of the end portion 9 of the rod 4 is a little longer than the length of the axial travel distance of the collar 53 in the housing 61.

This device operates as follows.

When in operation, the status of the device is as illustrated in FIG. 3 (fingers 7 are active), adapted to give support to the blank as it is lowered inside the well or conduit.

The thrust forces, from top downwards, on the maneuvering rod 4 are directly transmitted to the supporting member 6 by the collar 51.

The frangible pins have sufficient resistance so as not to break should undue traction forces develop during operation, which may be related to vibratory phenomena for example or Archimedes thrust which may be exerted on the member 6 (if the well or conduit contains fluid).

In the event of any difficulty such as mentioned above, when the blank is only partly expanded, the device can be withdrawn by traction on the rod 4 from bottom upwards, this traction being symbolized by arrow g in FIG. 12.

The body 6 is therefore hoisted until its fingers 7, which are in projecting position, come into contact with the lower edge of the non-expanded portion 11 of the blank.

Hoisting is therefore blocked, inducing sufficient forces at the pins 8 to cause shearing at the base of their head 8'—which remains in the body 6.

The maneuvering rod 4 therefore comes to be separated from this body 6 and can be hoisted, whilst the body 6 remains immobilized subsequent to the abutment of the fingers 7 against the lower edge of the blank.

The collar 53, which contains the rods 8" of the sectioned pins, therefore moves axially from bottom upwards inside the housing 61, until it comes to abut against the face 610.

Throughout this movement, the end portion 9 of smaller diameter has arrived opposite the fingers 7 which have therefore been pushed inwardly (arrows j) under urging by the springs 70, and have retracted into a retracted position which is inscribed within a circular section of smaller diameter than the inner diameter of the non-expanded portion 11 of the blank.

In this manner passing becomes possible, and the assembly can be withdrawn.

As will be explained with reference to FIGS. 13 and 14, it may be desirable to cover the casing A and liner B over zones whose length $L_A$, respectively $L_B$ (see FIG. 13) is much longer than the effective length of the expanding packers, e.g. three times longer.

In this case, expansion must be made step-by-step, with successive inflating/deflating phases, progressing in steps.

Control elements can be provided to block progression of the tool in the event that expansion does not take place correctly.

FIG. 14 shows a tool adapted to operate under these conditions, step-by-step.

The blank 1 is shown non-expanded in this figure, supported by the supporting fingers 7 of the supporting member 6.

The two packers 2, 3 are carried by the control rod 4 on which the control elements 22, 32 are also mounted.

The control element 22 is located just above the upper packer 2. It is in the form of a disc whose diameter is slightly larger than the inner diameter of the upper cylindrical blank portion 10.

This diameter is nonetheless slightly smaller than the inner diameter of this portion 10' after expansion.

Similarly, the control element 32 is located just above the lower packer 3. It is in the form of a disc whose diameter is a little larger than then the inner diameter of the lower cylindrical blank portion 13.

This diameter is nevertheless a little smaller than the inner diameter of this portion 13' after expansion.

The tool operates step-by-step from top downwards (Arrow F).

The two packers can work in synchronism, and can be inflated/deflated simultaneously.

The packers 2 and 3 therefore cause progressive expansion of parts 10 and 13 of the blank at the same time.

At least one of the two packers is advantageously mounted "floating" on the rod 4. In the illustrated example, this is the lower packer 3 on whose end pieces 30, 31 demand is placed by the elastic return members (compression springs) 300, 301 which respectively bear against the control element 32 and against a ring 33 joined to the rod 4.

This allows automatic offsetting of differences in radial expansion (and correlatively axial contraction) of the two packers 2 and 3, which tend naturally to draw them away or towards each other during each operational phase, thereby avoiding the onset of harmful mechanical stresses on the rod 4 and/or on the blank 1.

If one of the portions 10 or 13 is incorrectly or insufficiently expanded, the lowering of the corresponding control disc 22 or 32 becomes blocked, which alerts the operators and the expansion operation must be adjusted to arrive at the desired positioning diameter.

In the embodiment illustrated FIG. 15, the tool also operates step-by-step but this time from bottom upwards (Arrow G).

A control element 32 associated with the lower packer 3 is attached to the lower end of the rod 4; here it also acts as support for the blank 1 when it is placed in position in the well.

In the event of incorrect and/or insufficient expansion of the lower portion 13, this element 32 cannot pass through this portion, which blocks the rising of the tool.

On the other hand, in this embodiment there is no similar control element associated with the upper packer 2, which would ensure proper expansion of portion 10 of the blank.

According to FIG. 16,—in addition to the seals 100, 130 which line the upper 10 and lower 13 portions of the blank—provision is made for similar seals 15 which surround the intermediate portion thereof 11-12.

With reference to FIG. 17, the radial expansion of the blank takes place from bottom upwards (as in the situation shown FIG. 13).

In this figure, the seals 100 and 130 are not illustrated for reasons of simplification.

During a first phase, illustrated in the left half of FIG. 17, the lower packer causes radial expansion of the lower part 13A of portion 13 of the blank (arrows p1), which is applied tightly and firmly against the wall of the liner B.

The blank 1 is then immobilized at this point, held in translation.

During the remainder of radial expansion, from bottom upwards, illustrated in the right half of FIG. 15 and symbolized by arrows p2, the increase in diameter of the tubular portion 13 induces a reduction in its axial dimension, in a ratio which corresponds to Poissons's ratio (of the order of 0.5 for steel).

Since the lower part 13A is immobilized, downward traction is observed of the remainder of the blank (Arrow Z), the effect of which is to apply the seals 15 of the intermediate portion 11-12 against the conical entry wall PE of the hanger D.

The configuration and the dimensions of the blank are naturally determined so that, on completion of expansion of the lower portion 13, these seals 15 are suitably compressed to ensure an optimal seal at this point.

Expansion of the upper portion 10 is then conducted.

It can also be envisaged to expand the intermediate zone 11-12 of the blank by means of a packer to ensure or reinforce this perfect sealing.

It is to be noted that the same packer could be used for each of the two operations (expansion of the upper 10 and lower 13 portions) provided it has sufficient radial expanding capacity.

On the contrary, two separate tools (each with a packer) could in principle be used in turn, even if at first sight this appears to be less advantageous.

The intermediate zone between the two cylindrical portions of the blank is not necessarily bi-conical.

It could be "mono-conical"—as in FIG. 16—or of progressively variable shape by means of an intermediate element with curved profile and point of inflection.

In this case, the central element could be formed by stamping a cylindrical blank (on a press between punch and die) and then welded to the two cylindrical elements.

With respect to the tool, pre-inflation of at least one of the two packers should allow the blank to be retained simply by friction when it is placed in the well (since the weight of the blank is not very high) which would eliminate the need for the supporting member 6-7.

With reference to FIGS. 18 and 19, the mouth of the liner B here, at hanger D level, has been previously machined to obtain a circular-cross-section of constant inner diameter ΦB and smooth surface condition.

A blank 1 is inserted therein whose lower cylindrical portion 13 has an outer diameter Φ2 which is very slightly smaller than, practically equal to diameter ΦB, to the nearest insertion clearance.

The outer wall of the portion 13 is provided with O-rings 130.

This lower portion is positioned by sliding into the mouth, as can be seen in FIG. 19. In this manner a sealed assembly 130 is formed, by means of the seals 130.

The upper cylindrical portion 10 of the blank 1 then occupies the position illustrated on the left side of FIG. 19.

In this case, only the upper portion 10 is radially expanded to beyond its elastic limit, in the manner described above, so that it is applied closely and firmly and in leak-tight manner against the inner face of the wall of the casing A.

Once this operation is completed, the blank occupies the position shown on the right side of FIG. 19 (the elements 1, 10 and 130 then carrying the "prime" subscript).

In the embodiment shown in FIG. 20, the blank 1 has an upper portion 10 having a wall whose mean thickness is greater than that of the lower portion 13.

This upper portion comprises an annular groove cut in its outer face in which a seal 100 in swellable material is received.

With said blank, only the lower portion 13 is expanded beyond its elastic limit, so that it is applied closely and firmly, and in leak-tight manner, against the inner face of the liner B.

The seal 100 is then caused to swell until it is applied closely and in fully leak-tight manner against the inner face of the casing A.

This type of swelling seal is well known per se for applications in the area of oil well operation.

The swelling thereof is obtained simply by contacting with a determined fluid, which may be a fluid specially injected into the well or already present in the well.

This fluid may be water for example, mud, a hydrocarbon or a mixture of these substances.

In this respect, useful reference may be made to the document "Swelling Packers solve zonal-isolation challenge in Oman High pressure wells" (JPT March 2007), and to patent U.S. Pat. No. 3,918,523 (which provides information on the composition of swelling agents which can be used).

In the embodiment illustrated in FIG. 20, the presence will also be noted of flexible, elastic sealing rings 130 around the lower portion 13, capable of ensuring a perfect seal at this level subsequent to radial expansion of this portion 13.

Simply as examples, possible values of some parameters of the invention are given below:

Diameters ΦA and ΦA: respectively 226 and 166 mm;

Wall thickness of casing A and liner B: respectively 9 and 6 mm;

Diameters Φ1 and Φ2: respectively 205 and 150 mm;

Wall thickness of the blank 1: 5 mm;

Axial dimensions (=lengths) of portions 10, 11, 12 and 13 of this blank: respectively 3, 0.3, 0.3 and 3 meters;

Value of angles α1 and α2: respectively 30° and 10°;

Length of each deflated packer 2-3: 1.5 meters;

Pressure developed in these packers to expand the blank: 400 bars.

Value of the axial traction force causing rupture of the frangible pins in the connection system 5: 1.5 tonnes.

The invention claimed is:

1. A method for repairing a hanger of a liner to make the liner and hanger leak-tight, the liner being placed inside a casing of a well, wherein the method comprises, during a first phase, axially positioning a metal tubular blank in the well, the blank having a solid wall radially deformable beyond an elastic limit of the solid wall and including:

an upper cylindrical portion with an outer diameter that is slightly smaller than an inner diameter of the casing;

a lower cylindrical portion with an outer diameter that is slightly smaller than an inner diameter of the liner; and an intermediate portion having a diameter between the outer diameters of the upper and lower portions, wherein the positioning step is performed so that the lower portion of the blank is housed in a mouth of the liner whilst the upper portion lies opposite a region of the casing located above the hanger, the method further comprising, during a second phase, the step of causing radial expansion of each of the upper and lower cylindrical portions of the blank beyond their respective elastic limits to thereby apply the upper and lower portions closely and firmly against an inner face of a wall of the casing and the liner, respectively, thereby establishing a leak-tight seal between the blank and each wall, such radial expansion causing deformation of the intermediate portion of the blank to cover the hanger, wherein radial expansion of the upper and lower portions of the blank is caused by a tool carrying a pair of inflatable packer bladders positioned one above the other, and sized so that an upper packer bladder is adapted to expand the upper cylindrical portion of the blank, whilst a lower packer bladder is adapted to expand the lower cylindrical portion of the blank.

2. The method according to claim 1, wherein the outer diameter of the lower portion of the blank is very slightly smaller than, or substantially equal to, an inner diameter of the mouth of the liner, the lower portion being positioned in the liner by sliding such portion into said mouth and interpositioning seals on the lower portion between such portion and the wall of the liner.

3. The method according to claim 1, wherein the blank is positioned axially in the well by use of the tool, which comprises a supporting member provided with retractable fingers adapted to act as support for a lower edge of the blank as the blank is lowered and placed in the well.

4. The method according to claim 3, wherein the blank is positioned axially in the well by use of the tool and through inflation of at least one of the packer bladders until the blank is retained by friction.

5. The method according to claim 1, further comprising the step of first radially expanding the lower cylindrical portion and then radially expanding the upper cylindrical portion.

6. The method according to claim 5, wherein the blank includes annular seals on an outer face of the upper and lower cylindrical portions, and the intermediate portion, so that, subsequent to radial expansion of the lower portion, the intermediate portion is placed flat against the hanger establishing a leak-tight seal between the intermediate portion and the hanger.

7. The method according to claim 1, further comprising the step of first radially expanding the upper cylindrical portion and then radially expanding the lower cylindrical portion.

8. The method according to claim 1, wherein expansion of the upper and lower cylindrical portions is performed by successively inflating and then deflating one of the pair of packer bladders against the upper and lower cylindrical portions, such inflating and deflating progressing stepwise and not at the same time.

9. The method according to claim 1, wherein expansion of the upper and lower cylindrical portions is carried out simultaneously.

10. The method according to claim 1, wherein the tool includes a control rod carrying the pair of inflatable packer bladders positioned one above the other.

11. The method according to claim 10, wherein at least one of the packer bladders is slidingly mounted along said rod.

12. The method according to claim 11, wherein the tool, at a lower part of the rod, comprises a supporting member provided with retractable fingers, adapted to give support to a lower edge of the blank as the blank is lowered and placed in the well.

13. A blank used to repair a hanger of a liner to make the hanger and liner leak-tight, the liner being placed inside and along a casing of a well, wherein the blank comprises a metal tubular sleeve with a radially deformable wall that is deformable beyond an elastic limit of the wall, and coaxial upper and lower cylindrical portions, a diameter of the lower portion being smaller than a diameter of the upper portion, and an intermediate portion having a diameter between the respective diameters of the upper and lower portions, wherein the intermediate portion comprises two parts in the form of ferrules of a truncated cone shape, an upper ferrule of the intermediate portion being set at an angle with respect to a lower ferrule.

14. The blank according to claim 13, wherein an outer face of at least one of the upper and lower cylindrical portions, or of the intermediate portion, is provided with a series of annular seals, such seals being composed of flexible, elastic material that is swellable or expandable.

15. The blank according to claim 14, wherein the seals are bonded to the outer face.

16. The blank according to claim 14, wherein the seals are rings housed in receiving grooves cut in the outer face of the at least one of the upper and lower portions, or the intermediate portion.

* * * * *